United States Patent [19]

Godin

[11] 4,432,307

[45] Feb. 21, 1984

[54] GAS-OR LIQUID-FIRED HOT WATER BOILER

[75] Inventor: Pascal Godin, Eu, France

[73] Assignee: Societe Industrielle Auer, Paris, France

[21] Appl. No.: 403,426

[22] Filed: Jul. 30, 1982

[30] Foreign Application Priority Data

Aug. 3, 1981 [FR] France ..... 81 15027

[51] Int. Cl.[3] ..... F22B 5/00

[52] U.S. Cl. ..... 122/14; 165/78

[58] Field of Search ..... 110/234; 122/13 R, 18, 122/19, 14, 15, 20 A, 209 R, 216, 214, DIG. 14; 165/78

[56] References Cited

U.S. PATENT DOCUMENTS 2,938,712 5/1960 Pellmyr ..... 165/78 X 4,240,362 12/1980 Wigdahl ..... 122/20 A X 4,253,516 3/1981 Giardina ..... 165/78

FOREIGN PATENT DOCUMENTS 2270050 12/1975 France .

2308072 11/1976 France .

*Primary Examiner*—Edward G. Favors

*Attorney, Agent, or Firm*—Charles E. Brown

[57] ABSTRACT

A boiler is disclosed comprising a heat exchanger having a plurality exchanger modules which are plugged in upper and lower headers connected in the heating circuit of a central heating system. The headers are secured to the rear wall of a casing and the modules are slidably mounted in guideways in the casing. Upper and lower latch bars are biased to their latching positions for preventing the modules from being uncoupled with the headers under pressure in the heating circuit. The exchanger modules may be installed and removed separately without the need of any tools.

16 Claims, 7 Drawing Figures

FIG. 1
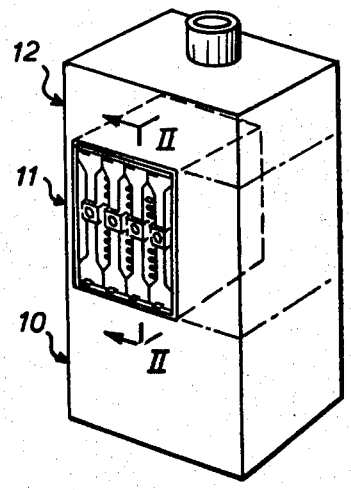
FIG. 5
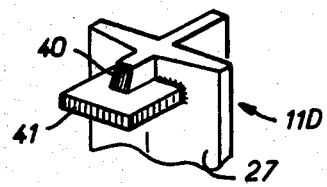
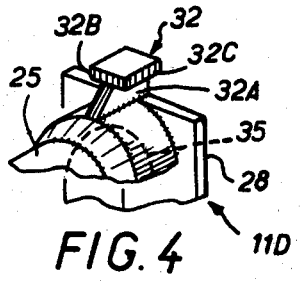
FIG. 4
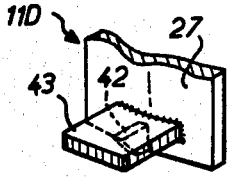
FIG. 6
FIG. 3
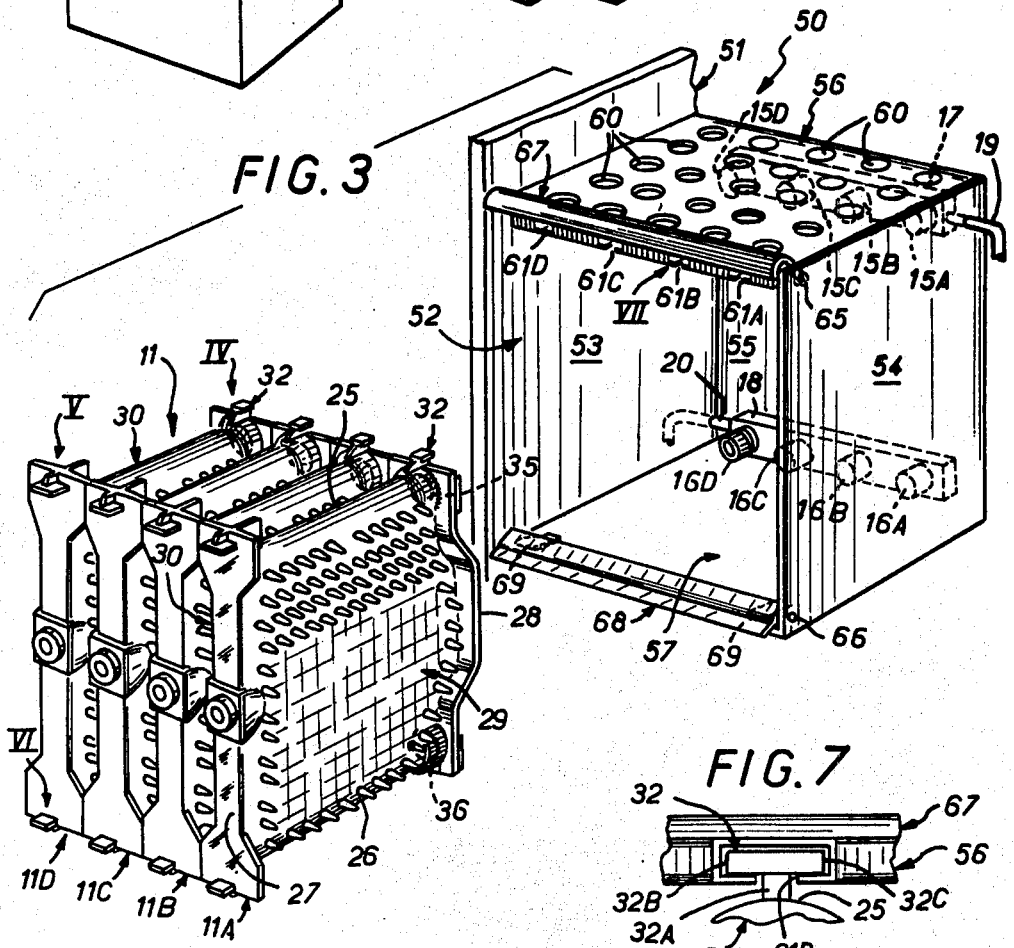
FIG. 7
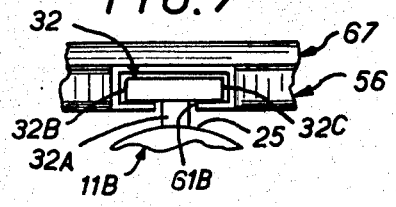

GAS-OR LIQUID-FIRED HOT WATER BOILER

The present invention relates to gas- or liquid-fired hot water boilers for central heating systems.

As is well known such boilers are usually wall-mounted through they can be supported on a floor and are connected to the heating circuit of the central heating system comprising a plurality of radiators to which hot water from the boiler is supplied by pipes and from which water is returned by pipes to the boiler after giving off a certain amount of heat.

Generally, such boilers comprise a support housing inside which are superposed from bottom to top a gas or liquid fuel burner, a combustion chamber where the fuel is consumed, a heat exchanger above the combustion chamber, and a gas flue for exhausting combustion gases.

The present invention is more particularly concerned with the heat exchanger of such boilers.

Up to now the various parts of the boiler, that is, the hear exchanger, the combustion chamber and the gas flue, are assembled in the factory so that the boiler is ready to be installed. But the ready-to-install boiler has a substantial weight and does not permit handling and especially not installation by a single workman. Consequently two workmen are required to install such boilers which obviously has repercussions on the ultimate price paid by the consumer.

Moreover, the maintenance of such boilers poses problems since it is necessary to dismount the boiler and change one or more parts which necessitates not only two skilled workmen but also requires the use of tools. It will be readily understood that since the time necessary for servicing present-day boilers is long the cost is high.

An object of the invention is the provision of a boiler, the handling, installation and maintenance of which are facilitated.

According to the invention there is provided a gas- or liquid-fired hot water boiler for a central heating system, comprising a housing containing a combustion chamber, a heat exchanger communicating with the combustion chamber and connected between an inlet header and an outlet header adapted to be connected respectively to a return pipe and a supply pipe of a central heating circuit, and a gas flue for exhausting combustion gases, characterized in that the heat exchanger comprises at least two plug-in exchanger modules, means for coupling each of the modules to each of the headers, and hand-operable latch means cooperable with the exchanger modules for locking the exchanger modules in their plugged-in position.

Preferably, the exchanger modules are of flat parallelepipedic configuration, each of the coupling means comprising a collar defining a port on one of the associated exchanger module and the associated header and a nozzle or tube adapted to fit into the collar on the other of the associated exchanger module and the associated header.

Preferably, the heat exchanger comprises a casing for receiving the exchanger modules and is disposed between the combustion chamber and the gas flue, the casing being fixed to the housing and comprises an open front, two lateral walls, an open bottom communicating with the combustion chamber, and a top wall having a plurality of apertures for the passage of combustion gases into the gas flue, and guideways for guiding the exchanger modules into and out of the casing, the latch means also being mounted on the casing.

Preferably, the latch means comprise upper and lower pivotally mounted latch bars extending respectively along the top and bottom of the casing for accommodating the exchanger modules, the upper latch bar being biased to its latching position by the force of gravity and the lower bar being biased to its latching position by spring means.

Such a heat exchanger may comprise two or more such separate elements which have the advantage of being installable individually at any desired location in the casing without the need of any tools.

It will have been understood that the boiler can be mounted without the heat exchanger modules therefore facilitating handling and installation since the heat exchanger modules constitute a substantial part of the weight of the entire boiler. Since the heat exchanger comprises easy-to-handle modules, the installation and starting-up of such a boiler may be carried out by a single workman. Similarly, as regards maintenance, since the exchanger modules are plug-in units the heat exchanger is more easily accessible and the exchanger modules may be removed one at a time without any tools.

Thus the problems posed to date by handling, installation and maintenance of such a boiler are overcome in a simple manner with the arrangements of the present invention.

These and other advantages and features of the invention will be brought out in the description which follows, given by way of example, with reference to the accompanying drawings.

FIG. 1 is a schematic perspective view of the boiler according to the invention;

FIG. 3 is an exploded perspective view of the heat exchanger comprising the exchanger modules, the headers and the casing for housing the same;

FIGS. 4, 5, 6 and 7 are larger scale perspective detail view of portions of the heat exchanger taken in the directions of arrows IV, V, VI and VII, respectively, in FIG. 3.

Figure 2:
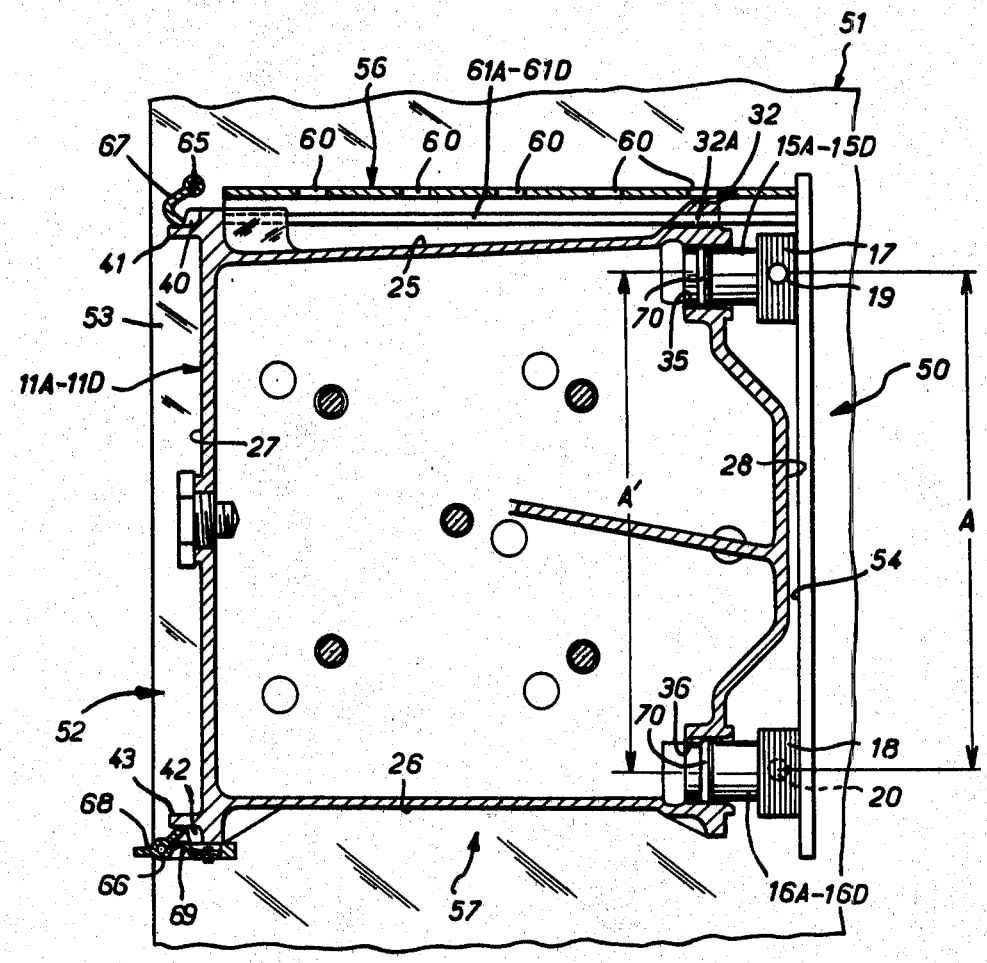
FIG. 2 is a view, on a larger scale, taken along plane through line II—II in FIG. 1.

In the embodiment illustrated in the drawings a gas- or liquid-fired hot water boiler for a domestic central heating system is shown comprising three superposed zones: in the bottom zone a combustion chamber 10 containing a gas or liquid fuel burner (not shown), a heat exchanger 11 above the combustion chamber, and a gas flue 12 for exhausting combustion gases disposed above the heat exchanger.

The heat exchanger 11 comprises at least two separate plug-in exchanger modules, and preferably four plug-in exchanger modules 11A, 11B, 11C and 11D as illustrated, plugged in inlet and outlet headers 17 and 18 respectively connected to the return pipe 20 and supply pipe 19 of the central heating circuit. The plug-in exchanger modules 11A–11D of the heat exchanger 11 are all of identical construction and therefore it will suffice to describe only one, i.e., exchanger module 11A, in detail.

At the corner defined by the top side 25 and rear side 28 of the exchanger module 11A (see FIG. 4) a T-shaped slide 32 is provided comprising a rib or leg 32A extending along the generally plane of the exchanger module 11A, and two cross portions 32B and 32C perpendicular to the rib 32A. The exchanger module 11A has an upper port defined by a collar 35 provided in the rear side 28 along with a lower port defined by a collar 36 adjacent the bottom side 26 of the exchanger module 11A.

The front side 27 of the exchanger module 11A comprises means cooperable with hand-operable latch means mounted on the casing. These means are symmetrical with respect to the median transverse plane of the exchanger module 11A and comprise as shown in FIGS. 5 and 6, respective longitudinal ribs 40, 42 parallel to the general longitudinal plane of the exchanger module 11A connected to respective transverse ribs 41, 43 perpendicular to associated ribs 40, 42, with the ribs 43 and 41 facing each other.

As illustrated, the exchanger modules 11A–11D are inserted into the casing 50 which in turn is fixed to the outer jacket or housing 51 of the boiler and is positioned between the combustion chamber 10 and the gas flue 12.

The casing 52 has an open front 52, lateral walls 53, 54 connected to a rear wall 55 and a top wall 56. The bottom 57 is also open for providing communication between the combustion chamber 10 and the spaces between the exchanger modules 11A–11D. The upper and lower headers 17, 18 are mounted on the rear wall 55 and comprise respective tubes or nozzles 15A–15D; 16A–16D. Associated pairs of tubes or nozzles 15A,16A; 15B,16B; 15C,16C; 15D,16D have an axis-to-axis spacing A equal to the axis-to-axis spacing of the collars 35, 36 in the exchanger modules.

The top wall 56 of the casing 52 also comprises a plurality of apertures 60 for the flow of combustion gases to the gas flue 12 and a guideway cooperable with each slide 32 on each exchanger module 11A–11D for properly aligning the ports in the collars 35 and 36 with the associated tubes or nozzles 15A–15D; 16A–16D. The guideways 32 are defined by a plurality of parallel slots formed by cutting and folding a metal sheet and securing it to the top wall 56 of the casing 52. The hand-operable latch means comprising latch bars 67, 68 are pivotally mounted by pivots 65,66 respectively. The upper latch bar 67 is freely pivotally mounted and downwardly biased by the force of gravity while the lower latch bar 68 is biased by at least one and preferably two leaf springs 69 as shown to urge the latch bar 68 to protrude inside the casing 52.

To install the exchanger modules 11A–11D inside the casing 52 and connect them to the headers 17, 18, the exchanger modules are inserted rear side first into the open front 52 of the casing and the slide 32 is engaged into the corresponding guideway 61A–61D after retracting the latch bar 67. The exchanger module 11A–11D is thus suspended from the top wall 56 of the casing and is slid rearwardly in the casing. At the end of its path of movement the exchanger module is automatically in position with its collars 35 and 36 respectively receiving the tubes or nozzles 15 and 16 as shown in FIG. 2. The collars 35, 36 and the associated tubes or nozzles 15A–15D; 16A–16D together with at least one sealing member, preferably an O-ring 70, per collar and tube or nozzle pair, comprise couplings between the exchanger modules 11A–11D and the upper and lower headers 17 and 18.

It will be noted that upon insertion of an exchanger module into casing 50, the lower latch bar 68 under the action of the weight of the exchanger module is temporarily retracted until the exchanger module is fully plugged in headers 17 and 18, whereupon leaf springs 69 return the lower latch bar 68 to its initial position.

Successive exchanger modules 11B–11D are plugged in the headers 17 and 18 in precisely the same manner. When all the exchanger modules are in the casing 52 the upper latch bar 67 is free and automatically falls under the force of gravity against the longitudinal ribs 40, whereas the lower latch bar 68 once free is urged by springs 69 into engagement with lower longitudinal ribs 42 whereby the upper and lower latch bars 68 and 69 lock all the exchanger modules in their plugged-in position and prevent them from being unplugged owing to the water pressure in the system.

Thus, it will be understood that the resulting heat exchanger 11 with its separate exchanger modules 11A–11D is extremely simple and readily assembled owing to the fact that the exchanger modules are merely inserted into the casing 52 whereupon they are automatically coupled to the headers 17 and 18 and locked into place without needing any tool.

For the purpose of maintenance each exchanger module may be removed from the casing 52 after retracting the upper and lower latch bars 68 and 69 by simply exerting a force to overcome their respective biasing forces.

It goes without saying that the invention is not limited to the illustrated and described embodiment but on the contrary is intended to encompass all alternatives and modications understood to those skilled in the art without departing from the scope of the appended claims.

What is claimed is:

1. A gas- or liquid-fired hot water boiler for a central heating system, said boiler comprising a housing containing a combustion chamber; a heat exchanger communicating with said combustion chamber and connected between an inlet header and an outlet header adapted to be connected respectively to a return pipe and a supply pipe of a central heating circuit; and gas flue means for exhausting combustion gases, the improvement wherein:

said heat exchanger comprises at least two plug-in exchanger modules, means for coupling each of said modules to each of said headers, and hand-operable latch means cooperable with said exchanger modules for locking said exchanger modules in their plugged-in position.

2. The boiler of claim 1, wherein said latch means are biased to lock automatically said exchanger into their plugged-in position.

3. The boiler of claim 1 or 2, wherein said exchanger are of flat parallelepipedic configuration, each of said coupling means comprising a collar defining a port on a selected one of the associated exchanger module and associated header and a tube adapted to fit into said collar on the nonselected one of said associated exchanger module and associated header.

4. The boiler of claim 3, wherein said collars are provided on said heat exchangers and said tubes are provided on said headers.

5. The boiler of claim 4, wherein said collars are provided at the top and bottom of rear sides of said exchanger modules.

6. The boiler of claim 1 or 2, wherein said latch means is cooperable with the front side of said exchanger modules for locking them in their plugged-in position.

7. The boiler of claim 1, wherein said heat exchanger comprises a casing for receiving said exchanger modules disposed between said combustion chamber and said gas flue means.

8. The boiler of claim 7, wherein said casing is fixed to said housing and comprises an open front, two lateral walls, an open bottom communicating with said combustion chamber, and a top wall having a plurality of apertures for the passage of combustion gases into said gas flue means, and guideways for guiding said exchanger modules into and out of said casing, said latch means also being mounted on said casing.

9. The boiler of claim 8, wherein said headers are carried on the rear wall of said casing.

10. The boiler of claim 1 or 2, wherein said latch means comprises upper and lower pivotally mounted latch bars extending respectively along the top and bottom of a casing for accommodating said exchanger modules, said upper latch bar being biased to its latching position by the force of gravity and said lower latch bar being biased to its latching position by spring means.

11. The boiler of claim 10, wherein the upper and lower ends of the front sides of said exchanger modules remote from said headers are provided with longitudinal rib means cooperable with said latch bars to abut there-against in the plugged-in position of said exchanger modules without retracting said latch bars.

12. The boiler of claim 8, wherein said guideways extending from the front to the rear of said casing comprise straight parallel slots for guiding movement of said exchanger modules in said casing.

13. The boiler of claim 12, wherein said guideways are cutout and folded zones of a sheet metal element immediately underlying said upper wall of said casing.

14. The boiler of claim 12, wherein slides for cooperating with said guideways are provided on said exchanger modules and are generally T-shaped, comprising a longitudinal rib and transverse ribs perpendicular to said longitudinal rib and extending from opposed sides thereof.

15. The boiler of claim 3, wherein said coupling means comprise sealing means between associated pairs of collars and nozzles.

16. The boiler of claim 15, wherein said sealing means comprise O-rings.

* * * * *